US009422091B2

(12) United States Patent
Martin

(10) Patent No.: US 9,422,091 B2
(45) Date of Patent: Aug. 23, 2016

(54) CLOSURE FOR CONTAINER

(71) Applicant: Berry Plastics Corporation, Evansville, IN (US)

(72) Inventor: Brian Martin, New Providence, PA (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 14/576,596

(22) Filed: Dec. 19, 2014

(65) Prior Publication Data

US 2015/0175325 A1 Jun. 25, 2015

Related U.S. Application Data

(60) Provisional application No. 61/918,502, filed on Dec. 19, 2013.

(51) Int. Cl.

| | |
|---|---|
| ***B65D 50/02*** | (2006.01) |
| ***B65D 50/04*** | (2006.01) |
| ***B65D 55/02*** | (2006.01) |
| ***B65D 50/08*** | (2006.01) |

(52) U.S. Cl.
CPC ..... *B65D 50/043* (2013.01); *B65D 50/046* (2013.01)

(58) Field of Classification Search
CPC ..... B65D 50/02; B65D 50/043; B65D 50/046
USPC ..... 215/217, 209
See application file for complete search history.

(56) References Cited

U.S. PATENT DOCUMENTS

| | | | | |
|---|---|---|---|---|
| 3,072,276 | A | 1/1963 | Nichols | |
| 3,700,133 | A * | 10/1972 | Bagguley | B65D 50/046 215/221 |
| 3,828,957 | A | 8/1974 | Marchant | |
| 3,881,625 | A * | 5/1975 | Landen | B65D 50/046 215/209 |
| 3,888,375 | A | 6/1975 | Gerk | |
| 3,917,097 | A | 11/1975 | Uhlig | |
| 3,941,268 | A | 3/1976 | Owens et al. | |
| 3,984,021 | A | 10/1976 | Uhlig | |
| 3,989,152 | A | 11/1976 | Julian | |
| 3,993,208 | A | 11/1976 | Ostrowsky | |
| 4,149,646 | A | 4/1979 | Julian | |
| 4,373,641 | A | 2/1983 | Banich et al. | |
| 4,752,013 | A | 6/1988 | Miller et al. | |
| 4,752,014 | A | 6/1988 | House et al. | |
| 4,948,002 | A | 8/1990 | Thornock et al. | |

(Continued)

FOREIGN PATENT DOCUMENTS

CA 2001079 A 4/1990

OTHER PUBLICATIONS

International Search Report and Written Opinion dated Apr. 6, 2015, relating to International Application No. PCT/US2014/071486.

*Primary Examiner* — Fenn Mathew
*Assistant Examiner* — Andrew T Kirsch
(74) *Attorney, Agent, or Firm* — Barnes & Thornburg LLP

(57) ABSTRACT

A package includes a container and a closure. The container is formed to include a product-storage chamber and a mouth opening into the product-storage chamber. The closure is configured to mount on the container to assume an installed position closing the mouth formed in the container when rotated relative to the container about a vertical axis of rotation in a closure-installation direction.

22 Claims, 4 Drawing Sheets

(56) References Cited

U.S. PATENT DOCUMENTS

| | | | |
|---|---|---|---|
| 5,038,454 | A | 8/1991 | Thornock et al. |
| D330,677 | S | 11/1992 | Thornock et al. |
| 5,230,433 | A | 7/1993 | Hamilton et al. |
| 5,383,564 | A | 1/1995 | Hamilton et al. |
| 5,413,233 | A | 5/1995 | Hall |
| 5,449,077 | A | 9/1995 | Seidler |
| 5,449,078 | A | 9/1995 | Akers |
| 5,460,281 | A | 10/1995 | Rapchak et al. |
| 5,462,182 | A | 10/1995 | Opresco |
| 5,671,853 | A | 9/1997 | Herr |
| 5,687,863 | A | 11/1997 | Kusz |
| 5,711,442 | A | 1/1998 | Kusz |
| 5,927,526 | A | 7/1999 | Herr |
| 6,036,036 | A | 3/2000 | Bilani et al. |
| 6,112,921 | A | 9/2000 | Robinson |
| 6,378,713 | B2 | 4/2002 | Montgomery |
| 6,854,613 | B2 | 2/2005 | Biesecker et al. |
| 8,240,491 | B2 | 8/2012 | Beecroft et al. |
| 8,371,463 | B2 | 2/2013 | Beecroft |
| 2006/0283831 | A1 | 12/2006 | Krueger |
| 2007/0194047 | A1 | 8/2007 | Tauber et al. |
| 2008/0142468 | A1 | 6/2008 | Delagrange |
| 2008/0223811 | A1 | 9/2008 | Miceli et al. |
| 2010/0025355 | A1 | 2/2010 | Beecroft |
| 2010/0200533 | A1 | 8/2010 | Rice |
| 2012/0138562 | A1 | 6/2012 | Letica et al. |

* cited by examiner

CLOSURE FOR CONTAINER

PRIORITY CLAIM

This application claims priority under 35 U.S.C. §119(e) to U.S. Provisional Application Ser. No. 61/918,502, filed Dec. 19, 2013, which is expressly incorporated by reference herein.

BACKGROUND

The present disclosure relates to packaging, and particularly to child-resistant packaging. More particularly, the present disclosure relates to child-resistant packaging that includes a closure-release control mechanism used to release a closure from a container.

Child-resistant packaging is used to store products such as cleaning products. To prevent unwanted opening by children, such packaging is often configured to require multiple actions to remove a closure from a companion container.

SUMMARY

According to the present disclosure, a package includes a container and a closure. The container is formed to include a product-storage chamber and a mouth opening into the product-storage chamber. The closure is configured to mount on the container to assume an installed position closing the mouth formed in the container when rotated relative to the container about a vertical axis of rotation in a clockwise closure-installation direction.

In some embodiments, a child-resistant package further includes a closure-release control mechanism including a rotation-blocking stop, a movable release element, and an inclined locking tab. The rotation-blocking stop is coupled to the closure to rotate therewith about the vertical axis of rotation during installation of the closure on the container and removal of the closure from the container. The movable release element is mounted on the container for downward movement relative to the container away from the closure. The locking tab is coupled to the movable release element for movement therewith and arranged to engage the rotation-blocking stop to block rotation of the closure about the vertical axis of rotation in a counterclockwise closure-removal direction normally to retain the closure in the installed position on the container.

In some embodiments, the locking tab includes a sloped upper surface and a stop surface. The movable release element is mounted on the container such that the inclined locking tab pivots downwardly about a horizontal pivot axis during exposure to a first pivot-inducing force applied to the sloped upper surface included in the locking tab by the rotation-blocking stop during rotation of the closure about the vertical axis of rotation in the clockwise closure-installation direction. The inclined locking tab pivots downwardly to free the rotation-blocking stop to confront the stop surface included in the locking tab upon arrival of the closure at the installed position on the container.

In some embodiments, the movable release element is mounted on the container such that the inclined locking tab pivots downwardly about the horizontal pivot axis during exposure to a second pivot-inducing force applied to the locking tab by the movable release element during movement of the movable release element relative to the container in a downward direction away from the closure. The inclined locking tab pivots downward to move the stop surface included in the locking tab away from confronting relation with the rotation-blocking stop to free the closure for rotation about the vertical axis of rotation in the counterclockwise closure-removal direction relative to the container during removal of the closure from the container.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a child-resistant package in accordance with the present disclosure showing a container, a closure mounted on the container to cover a mouth opening into an interior formed in the container, and a closure-release control mechanism having an inclined locking tab and a movable release element (shown at six o'clock on the container) that is coupled to the container and configured to disengage the inclined locking tab coupled to the movable release element from a rotation-blocking stop included in the closure-release control mechanism to permit the release of the closure from the container upon the application a downwardly directed push force to the movable release element by a consumer as suggested in FIGS. 9A and 9B;

FIG. 2 is an exploded view of the child-resistant package of FIG. 1 showing the closure separated from the container to reveal a pair of blade-shaped rotation-blocking stops coupled to a perimeter edge of a rim of the closure and showing the movable release element coupled to generally horizontal platform included in the container and the inclined locking tab included in the closure-release control mechanism and configured to engage one of the rotation-blocking stops in the closure as suggested in FIGS. 5-8B to block removal of the closure from the container until a radially inwardly directed push force is applied to the movable release element;

FIG. 3 is an enlarged partial perspective view of one of the circled regions of FIG. 2 showing one of the two blade-shaped rotation-blocking stops coupled to the perimeter edge of the rim of the closure;

FIG. 4 is an enlarged partial perspective view of the other circled region of FIG. 2 showing the inclined locking tab coupled to an elastic flange of the movable release element and arranged to lie between a raised engagement ridge included in the movable release element and a neck included in the container and showing that the elastic flange of the movable release element is supported by a pliable web which interconnects the elastic flange for movement relative to the container in response to application of the downwardly directed push force to the movable release element;

FIGS. 5-8B are a series of partial perspective views showing installation of the closure on the container to cause one of the blade-shaped rotation-blocking stops coupled to the closure to engage the inclined locking tab coupled to the container to limit rotation of the closure relative to the container in a counter-clockwise closure-removal direction;

FIG. 5 is an enlarged internal partial perspective view of the child-resistant package of FIGS. 1-4 showing the blade-shaped rotation-blocking stop included in the closure-release control mechanism coupled to the closure moving to the right toward the inclined locking tab coupled to the movable release element to move downwardly as suggested in FIG. 6;

FIG. 6 is a view similar to FIG. 5 showing the rotation-blocking stop as it is moved toward and engages the locking tab of the closure-release control mechanism so that the locking tab is moved downwardly out of a travel path of the rotation-blocking stop during movement of the closure in a clockwise closure-installation direction to install the closure on the container;

Figure 5:
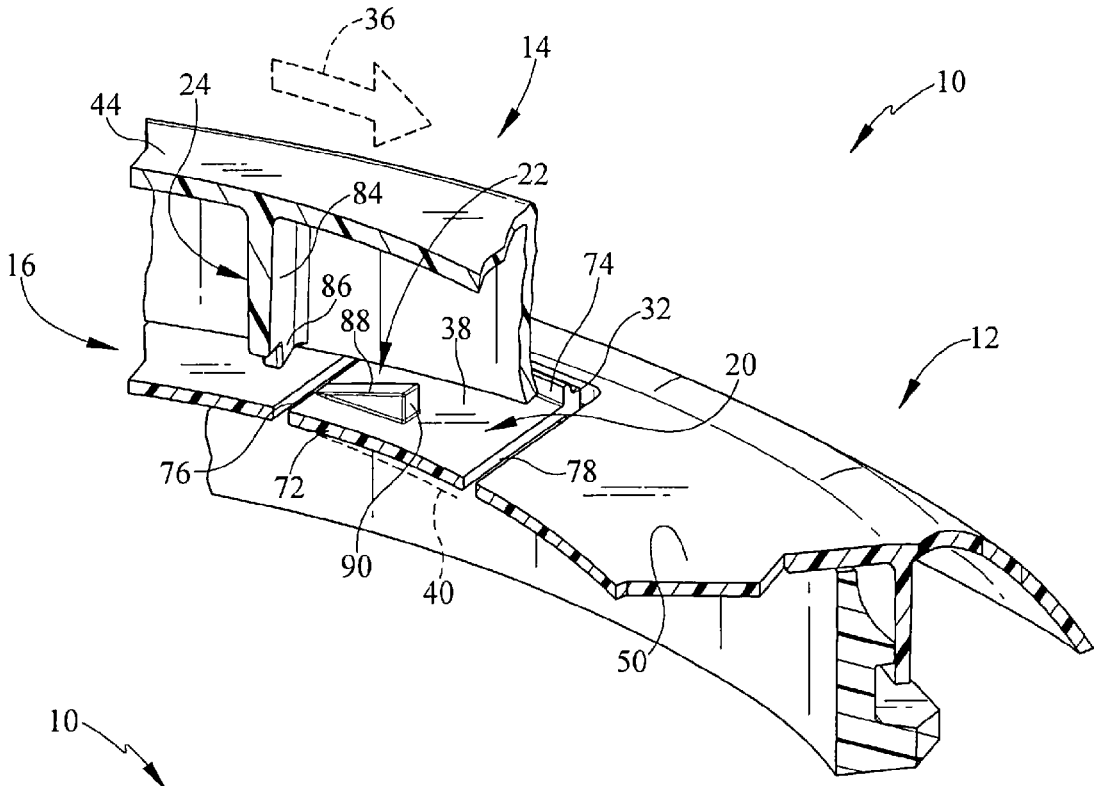
Figure 6:
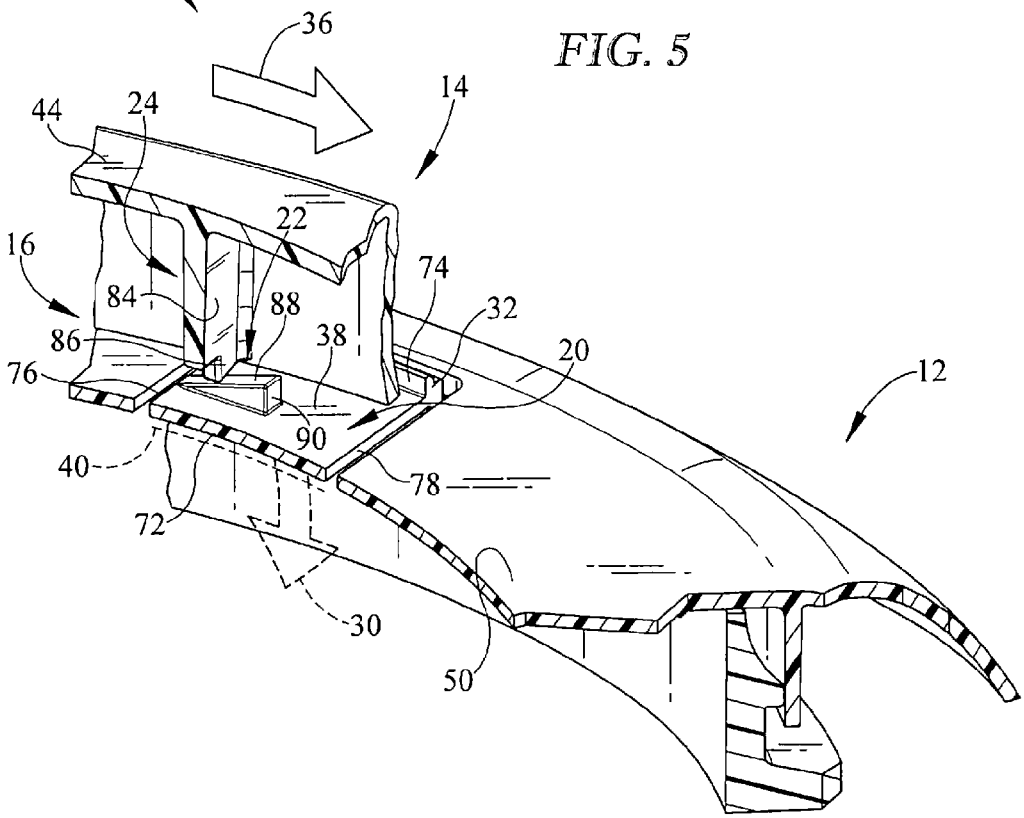
Figure 7A:
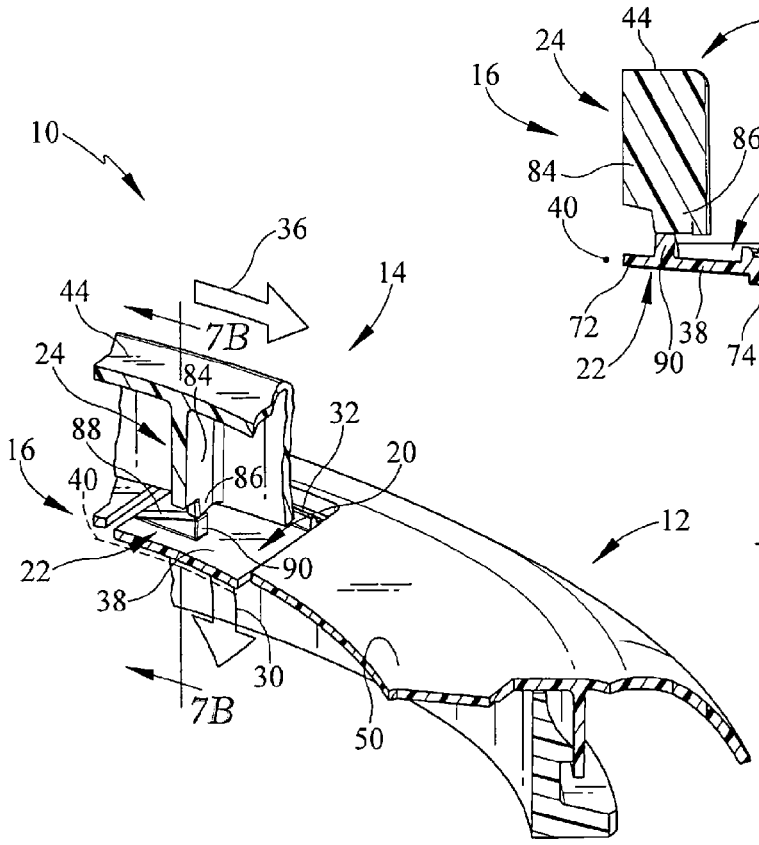
FIG. 7A is a view similar to FIGS. 5 and 6 showing the rotation-blocking stop has continued to move the locking tab downwardly as the closure is rotated in the clockwise closure-installation direction.
Figure 7B:
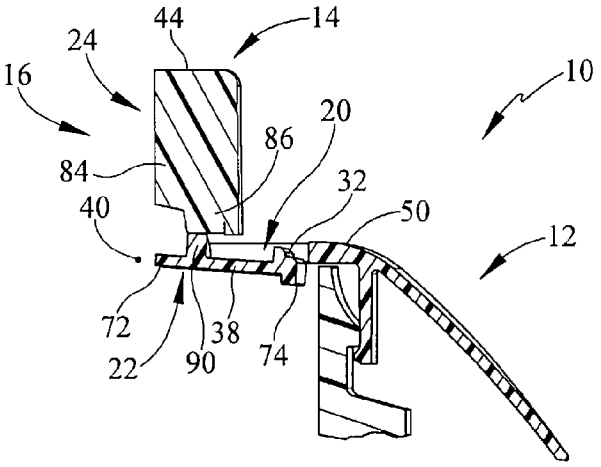
FIG. 7B is a sectional view taken along line 7B-7B of FIG. 7A showing that rotation-blocking stop has engaged the locking tab causing the locking tab and the movable release element to move downwardly.
Figure 8A:
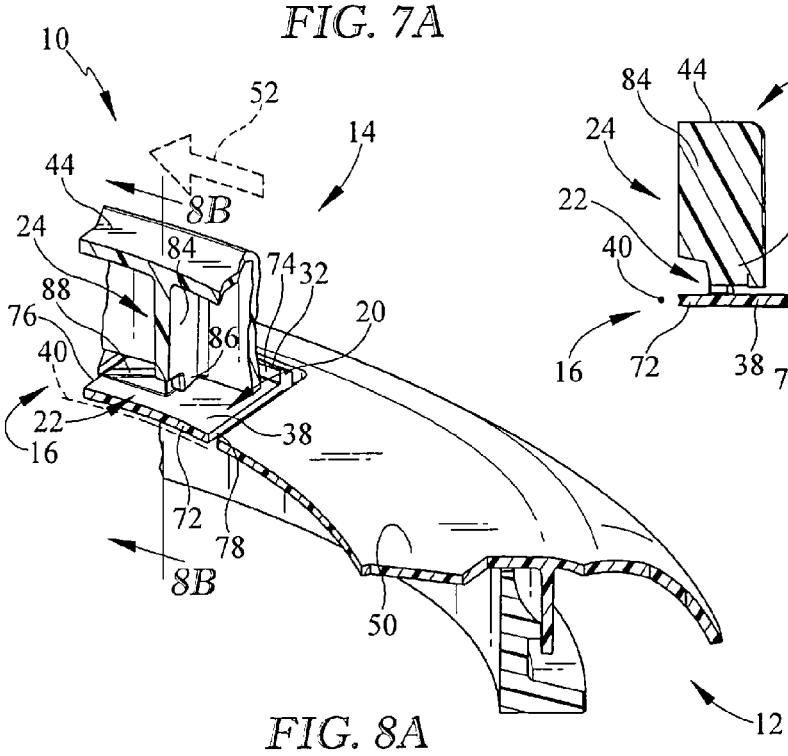
Figure 8B:
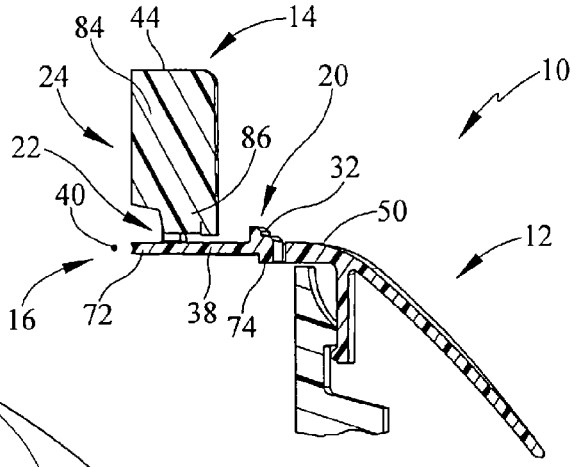
Figure 9A:
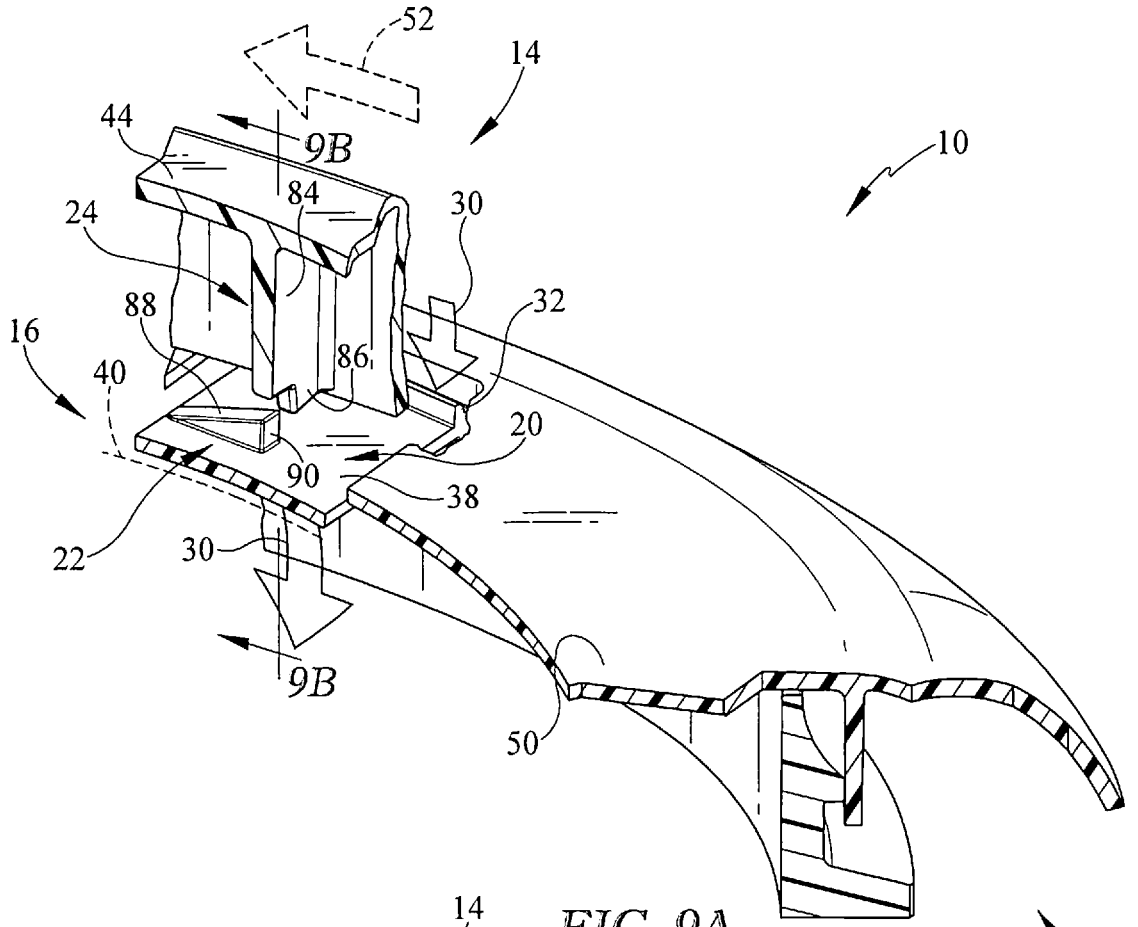
Figure 9B:
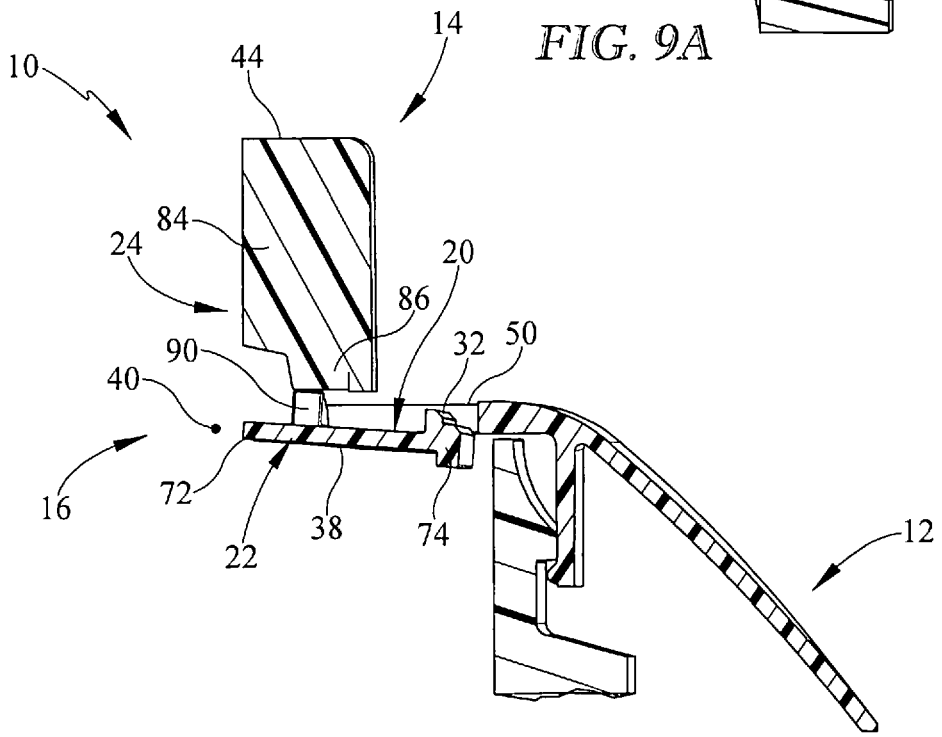

FIG. 8A is a view similar to FIGS. 5, 6, and 7A showing the locking tab in a locked position in the pathway of the rotation-blocking stop coupled to the closure after the rotation-blocking stop has cleared the end of the locking tab and the elastic movable release element has snapped back (i.e., pivoted upwardly about a horizontal pivot axis) to resume its initial position to block rotation of the closure in the counter-clockwise closure-removal direction to remove of the closure from the container;

FIG. 8B is a sectional view taken along line 8B-8B of FIG. 8A showing that once the rotation-blocking stop moves past the locking tab, the elastic movable release element moves upwardly to locate the locking tab in the pathway of the rotation-blocking stop;

FIG. 9A is a view similar to FIGS. 5, 6, 7A, and 8A during removal of the closure from the container showing downward movement of the locking tab in response to downward movement of the movable release element to cause the rotation-blocking stop on the closure to unmate from the locking tab so that subsequent counterclockwise rotation of the closure and the rotation-blocking stop is permitted after the stop disengages the locking tab and the closure is able to be removed from the container; and FIG. 9B is a sectional view taken along line 9B-9B of FIG. 9A showing that application of a downward release force to the movable release element causes the locking tab to move therewith out of the removal pathway of the rotation-blocking stop during rotation of the closure in the counter-clockwise closure-removal direction.

DETAILED DESCRIPTION

Figure 1:
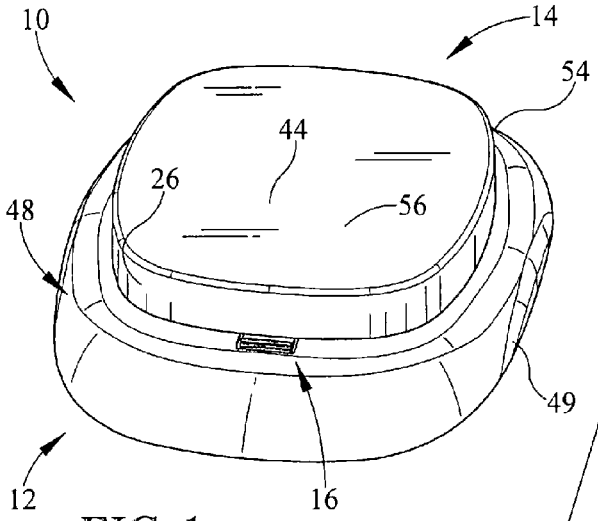
Figure 2:
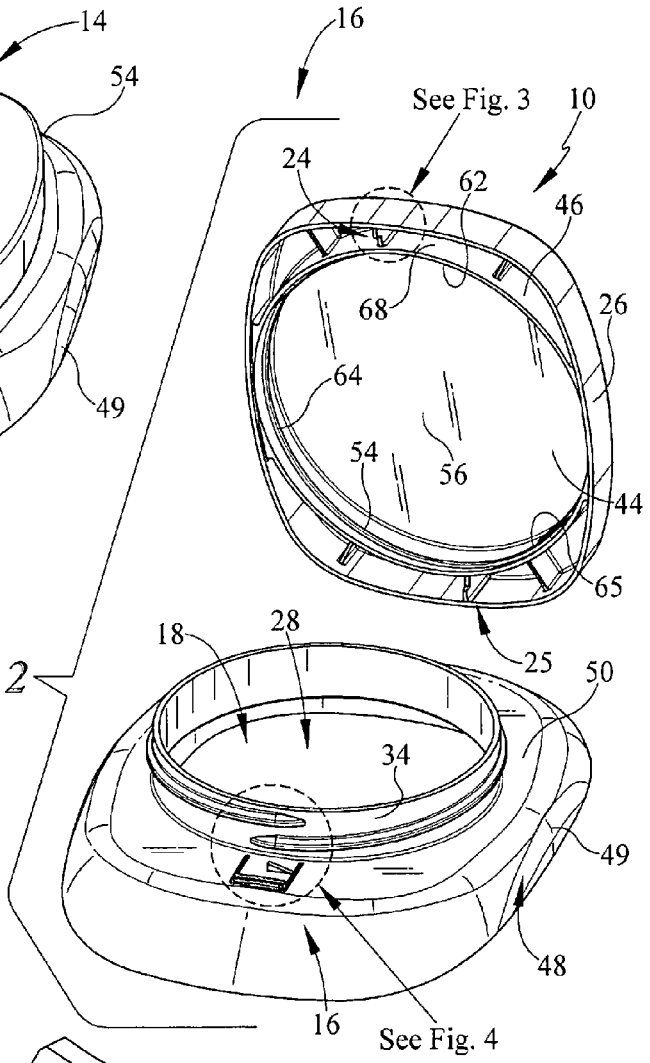

A child-resistant package 10 in accordance with the present disclosure is shown, for example, in FIGS. 1 and 2. Child-resistant package 10 includes a container 12 and a closure 14 mounted on container 12 to cover a mouth 18 opening into a product-storage chamber 28 formed in container 12, as shown in the illustrative embodiment of FIGS. 1 and 2. Child-resistant package 10 also includes a closure-release control mechanism 16 configured to control release of closure 14 from container 12. Closure-release control mechanism 16 comprises a movable release element 20 coupled to container 12 for pivotable movement about a horizontal pivot axis 40 during installation of closure 14 on container 12, an inclined locking tab 22 mounted on movable release element 20, and a pair of downwardly extending rotation-blocking stops 24, 25 coupled to a rim 26 of closure 14, as shown in FIGS. 2, 3, and 5-9B.

Removal of closure 14 from container 12 is blocked when inclined locking tab 22 included in closure-release control mechanism 16 and coupled to movable release element 20 is positioned to lie in the pathway of rotation-blocking stops 24, 25, as shown in FIG. 8A. When a consumer pushes movable release element 20 in a downwardly direction 30, inclined locking tab 22 moves out of the pathway of rotation-blocking stops 24, 25 to permit counterclockwise rotation and removal of closure 14 from container 12, as shown in FIGS. 8A-9B.

Child-resistant package 10 includes container 12, closure 14, and closure-release control mechanism 16 as shown in FIGS. 1 and 2. Container 12 is formed to include mouth 18 opening into product-storage chamber 28 and is configured to store products such as, for example, cleaning products in product-storage chamber 28. Closure 14 is mounted on container 12 to close mouth 18 and block access to product-storage chamber 28. Closure-release control mechanism 16 is configured to control release of closure 14 from container 12.

Figure 4:
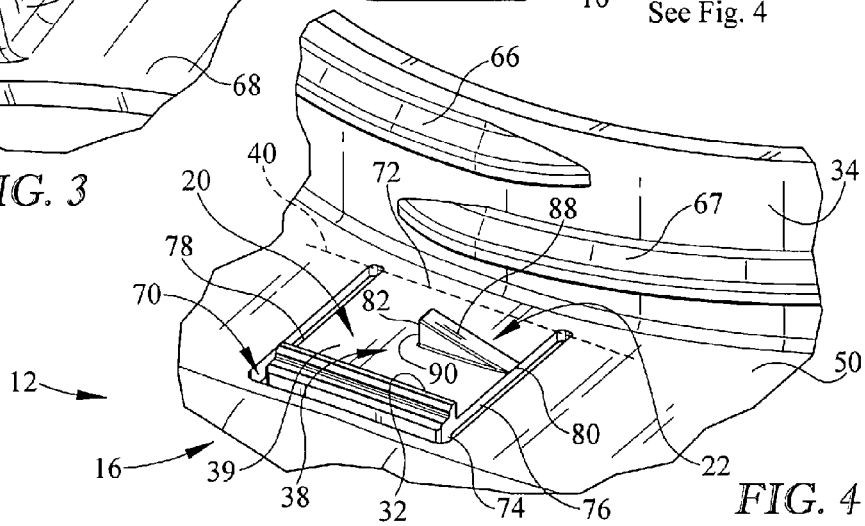

Container 12 includes a body 48 formed to include product-storage chamber 28 therein and a filler neck 34, as shown in FIG. 2. Filler neck 34 is adapted to accept closure 14 and close mouth 18 so that the contents of container 12 are trapped in product-storage chamber 28. Product-storage chamber 28 is adapted to contain product, such as cleaning products, and is closed when closure 14 is coupled to filler neck 34 of container 12. Closure 14 is arranged to be coupled to container 12 after rotation of closure 14 about axis of rotation 17, as shown, for example, in FIG. 1. Filler neck 34 is coupled to body 48 to extend upwardly away from body 48. Body 48 includes floor (not shown) adapted to support container 12 on ground underlying container 12, a side wall 49 coupled to the floor to extend upwardly, and a generally horizontal platform 50 coupled to side wall 49 to extend between and interconnect side wall 49 and filler neck 34 as shown in FIGS. 2 and 4.

Closure 14 includes a top surface 44, a rim 26, and a retainer ring 46 as shown in FIGS. 1 and 2. Top surface 44 closes mouth 18 when closure 14 is mounted to container 12. Rim 26 extends downwardly from top surface 44 and blocks access to inclined locking tab 22 and rotation-blocking stops 24, 25 of closure-release control mechanism 16 when closure is mounted to container 12. Retainer ring 46 is configured to mate with filler neck 34 included in container 12 to couple closure 14 to container 12.

Top surface 44 is generally flat and is about parallel with platform 50 of closure 14 as shown in FIG. 1. Top surface 44 includes an outer perimeter 54 and an inner body 56. Top surface 44 has a generally rectangular shape and rounded corners. Top surface 44 is sized such that outer perimeter 54 extends beyond mouth 18 and inner body 56 completely covers mouth 18 to block access to product-storage chamber 28, when closure 14 is coupled to container 12.

Rim 26 extends downwardly from outer perimeter 54 of top surface 44 toward container 12 as shown in FIGS. 1 and 2. As such, rim 26 is generally perpendicular to top surface 44. Rotation-blocking stops 24, 25 are coupled to rim 26. Rim 26 covers rotation-blocking stops 24, 25 and inclined locking tab 22 when closure 14 is coupled to container 12 to block access to rotation-blocking stops 24, 25 and inclined locking tab 22.

Retainer ring 46 extends downwardly from inner body 56 of top surface 44 as shown in FIG. 2. Retainer ring 46 has a circular shape and is configured to mate with filler neck 34 included in container 12. Retainer ring 46 includes an inner retainer surface 62, closure threads 64, 65, and an outer retainer surface 68. Inner retainer surface 62 is sized to engage filler neck 34. Closure threads 64, 65 are coupled to inner retainer surface 62 and are configured to engage corresponding container threads 66, 67 included in filler neck 34.

Closure threads 64, 65, 66, 67 include first ends and second ends offset from the first ends on inner retainer surface 62 by about 180 degrees. Threads 64, 65, 66, 67 cooperate to allow a consumer to install closure 14 onto container 12 in either a first position, shown in FIG. 2, or a second position, in which closure 14 is rotated 180 degrees about axis of rotation 17 opposite of the first direction. Outer retainer surface 68 faces rim 26. Rotation-blocking stops 24, 25 are coupled to and extend between rim 26 and outer retainer surface 68.

Closure-release control mechanism 16 includes movable release element 20 coupled to container 12 for pivotable movement about horizontal pivot axis 40 during installation of closure 14 on container 12, inclined locking tab 22 mounted on movable release element 20, and downwardly extending rotation-blocking stops 24, 25 coupled to rim 26 of closure 14, as shown in FIGS. 2, 3, and 5-9B. Rotation-blocking stop 24 is coupled to closure 14 to rotate therewith about vertical axis of rotation 17 during installation of closure 14 on container 12 and removal of closure 14 from container 12. Movable release element 20 is mounted on container 12 for radial movement relative to container 12 toward vertical axis of rotation 17. Inclined locking tab 22 coupled to movable release element 20. Inclined locking tab 22 is arranged to engage rotation-blocking stop 24 to block rotation of closure 14 about vertical axis of rotation 17 in a counter-clockwise closure-removal direction 52, also called a second closure-removal direction 52, normally to retain closure 14 in the installed position on container 12. Inclined locking tab 22 includes a sloped upper surface 88 and a stop surface 90.

Figure 3:
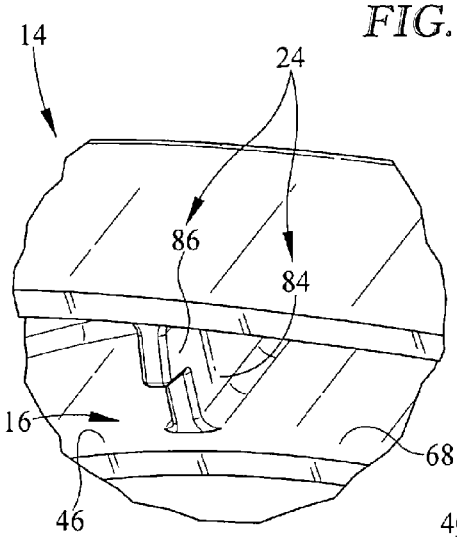

Rotation-blocking stops 24, 25 of closure-release control mechanism 16 are coupled to rim 26 of closure 14, as shown, for example, in FIG. 3. Rotation-blocking stops 24, 25 are positioned on rim 26 to extend downwardly away from top surface 44 so that rotation-blocking stops 24, 25 can engage with pivotable inclined locking tab 22 to block the counter-clockwise rotation and removal of closure 14 from container 12, as suggested in FIGS. 8A and 8B. Rotation-blocking stop 24 is coupled to rim 26 and spaced apart by 180 degrees from rotation-blocking stop 25. Rotation-blocking stop 25 is substantially the same as rotation-blocking stop 24. As such, rotation-blocking stop 25 will not be discussed in detail.

Rotation-blocking stop 24 includes a stop body 84 and a stop arm 86 coupled to stop body 84 as shown in FIG. 3. Stop body 84 extends between rim 26 and retainer ring 46. Stop body 84 extends downwardly away from top surface 44 toward platform 50, but terminates above inclined locking tab 22. Stop arm 86 is coupled to stop body 84 and extends downwardly from stop body 84 toward platform 50 to engage inclined locking tab 22.

When closure 14 is being installed onto container 12, stop arm 86 engages inclined locking tab 22 to push inclined locking tab 22 downwardly until stop arm 86 rotates past inclined locking tab 22, at which point inclined locking tab 22 pivots upwardly into an unpivoted position as shown in FIGS. 7A-8B. If a consumer rotates closure 14 in the counter-clockwise closure-removal direction 52 without pushing downwardly on closure-release control mechanism 16, stop arm 86 engages inclined locking tab 22 and is blocked from further rotation. Thus, closure 14 is blocked from being removed from container 12. To remove closure 14 from container 12 a consumer pushes movable release element 20 downwardly in direction 30 to move inclined locking tab 22 downward out of the pathway of rotation-blocking stop 24. Once inclined locking tab 22 is positioned to lie downwardly of rotation-blocking stop 24, closure 14 can be rotated in counter-clockwise closure-removal direction 52 to permit removal of closure 14 from container 12.

Movable release element 20 of closure-release control mechanism 16 is coupled to platform 50 for pivotable movement relative to platform 50 about horizontal pivot axis 40 as shown in FIG. 4. Movable release element 20 includes a deformable flange 38 and a raised engagement ridge 32 coupled to deformable flange 38. Deformable flange 38 and raised engagement ridge 32 cooperate to allow for downward movement of movable release element 20 to move inclined locking tab 22 in a downward direction to disengage rotation-blocking stop 24 as suggested in FIGS. 9 and 9B. Downward movement of movable release element 20 about horizontal pivot axis 40 allows for the release of closure 14 from container 12.

Deformable flange 38 is coupled to platform 50 and inclined locking tab 22 for pivotable movement about horizontal pivot axis 40 to move inclined locking tab 22 out of the pathway of rotation-blocking stop 24 as shown in FIG. 4. Deformable flange 38 includes a coupled end 72 coupled to container 12, a ridge end 74 spaced apart from and opposite coupled end 72, a tab side 76, also called a first side 76, extending between coupled end 72 and ridge end 74, and a receiver side 78, also called a second side 78, spaced apart from and opposite tab side 76. Deformable flange 38 further includes an upper surface 39 arranged to face upwardly toward closure 14. Coupled end 72 is coupled to platform 50 and configured to deform elastically while pivoting about horizontal pivot axis 40.

Platform 50 is formed to include a number of slots 70 that separate end 74 and sides 76 and 78 from platform 50 so that end 74 and sides 76 and 78 are free to pivot relative to platform 50 as shown in FIG. 4. In one example, slots 70 may be covered with a thin film extending between end 74 and sides 76 and 78 and platform 50.

Raised engagement ridge is coupled to and extends along ridge end 74. A first end 80 of inclined locking tab 22 is coupled to tab side 76. Inclined locking tab 22 extends away from tab side 76 toward receiver side 78 such that a second end 82 of inclined locking tab 22 is positioned between tab side 76 and receiver side 78.

Raised engagement ridge 32 is pressed in a downward direction by a consumer to cause deformable flange 38 to pivot downwardly about horizontal pivot axis 40 at coupled end 72 as shown in FIGS. 9A and 9B. As such, inclined locking tab 22 coupled to deformable flange 38 pivots downwardly out of the pathway of rotation-blocking stop 24.

Inclined locking tab 22 includes a sloped upper surface 88 and a stop surface 90 as shown in FIG. 4. Sloped upper surface 88 is configured to be engaged by rotation-blocking stops 24, 25 of closure 14 during rotation of closure 14 in a clockwise closure-installation direction 36, also called a first closure-installation direction 36, on container 12 to cause inclined locking tab 22 to pivot downwardly in direction 30 about horizontal pivot axis 40 to allow rotation-blocking stops 24, 25 to move past inclined locking tab 22 during installation of closure 14 onto container 12, as shown, for example, in FIGS. 5-8B.

Inclined locking tab 22 is coupled to deformable flange 38 for downward pivotable movement about a horizontal pivot axis 40 during exposure to a first pivot-inducing force applied to sloped upper surface 88 included in inclined locking tab 22 by rotation-blocking stop 24 during rotation of closure 14 about vertical axis of rotation 17 in the clockwise closure-installation direction 36 as shown in FIGS. 5A-7B. This downward pivotable movement of inclined locking tab 22 acts to free rotation-blocking stop 24 to confront stop surface 90 included in inclined locking tab 22 upon arrival of closure 14 at the installed position on container 12.

Inclined locking tab 22 is coupled to movable release element 20 such that the first end of inclined locking tab 22 is proximate tab side 76 of movable release element 20 as shown in FIG. 4. Inclined locking tab 22 extends toward receiver side 78 such that the second end of inclined locking tab 22 is positioned about halfway between tab side 76 and receiver side 78. Inclined locking tab 22 is coupled to movable release element 20 about halfway between coupled end 72 and ridge end 74.

Inclined locking tab 22 is configured to engage one of rotation-blocking stops 24, 25 included in closure 14 to block removal of closure 14 from container 12 until a downwardly directed push 30 is applied to raised engagement ridge 32 of movable release element 20, as shown sequentially in FIGS. 9A-9B. Rotation of closure 14 in a clockwise closure-installation direction 36 causes rotation-blocking stops 24, 25 to engage inclined locking tab 22 to cause inclined locking tab 22 to deflect and move about horizontal pivot axis 40 in downward direction 30, as shown in FIGS. 5-8B. Downward movement of inclined locking tab 22 by rotation-blocking stops 24, 25 about horizontal pivot axis 40 causes movement of movable release element 20 relative to platform 50. Application of downwardly directed push 30 to raised engagement ridge 32 by a consumer causes inclined locking tab 22 to move downwardly of rotation-blocking stops 24, 25 in direction 30 about horizontal pivot axis 40 to allow for removal of closure 14 from container 12.

In use, a manufacturer fills product-storage chamber 28 of container 12 with cleaning products and screws closure 14 onto filler neck 34 of container 12 in clockwise closure-installation direction 36 as shown in FIG. 1. Rotation of closure 14 onto container 12 in clockwise closure-installation direction 36 causes rotation-blocking stop 24 to engage sloped upper surface 88 of inclined locking tab 22 and move inclined locking tab 22 in a downward direction 30, out of the pathway of rotation-blocking stop 24, as shown in FIGS. 5-7B. Continued rotation of closure 14 in clockwise closure-installation direction 36 causes rotation-blocking stop 24 to move past inclined locking tab 22, allowing inclined locking tab 22 to spring back and block the closure-removal pathway of rotation-blocking stop 24, as shown in FIGS. 8A and 8B.

To remove closure 14 from container 12, to allow access products stored within product-storage chamber 28 of container 12, a consumer pushes with a first hand movable release element 20 downwardly in direction 30 as shown in FIGS. 9 and 9B. Downward movement of movable release element 20 causes movable release element 20 to move inclined locking tab 22 downward in direction 30 to move inclined locking tab 22 out of the pathway of rotation-blocking stop 24. Once inclined locking tab 22 is positioned to lie downwardly of rotation-blocking stop 24, closure 14 can be rotated by a different second hand of the consumer in counter-clockwise closure-removal direction 52 to permit removal of closure 14 from container 12.

In one illustrative example, the first closure-installation direction is a clockwise closure-installation direction while the second closure-removal direction is a counterclockwise closure-installation direction. In another example, the first closure-installation direction is a counterclockwise closure-installation direction while the second closure-removal direction is a clockwise closure-installation direction.

The invention claimed is:

1. A child-resistant package comprising a container formed to include a product-storage chamber and a mouth opening into the product-storage chamber, a closure configured to mount on the container to assume an installed position closing the mouth when rotated relative to the container about a vertical axis of rotation in a first closure-installation direction, and a closure-release control mechanism comprising a first rotation-blocking stop coupled to the closure to rotate therewith about the vertical axis of rotation during installation of the closure on the container and removal of the closure from the container, a movable release element coupled to the container for movement relative to the container away from the closure, and a locking tab coupled to the movable release element for movement therewith and arranged to engage the first rotation-blocking stop to block rotation of the closure about the vertical axis of rotation in a second closure-removal direction to retain the closure in the installed position on the container, the locking tab including a sloped upper surface and a stop surface, wherein the movable release element is coupled to the container to cause the locking tab to pivot downwardly about a horizontal pivot axis in response to a first pivot-inducing force applied to the sloped upper surface included in the locking tab by the first rotation-blocking stop during rotation of the closure about the vertical axis of rotation in the first closure-installation direction to free the first rotation-blocking stop to confront the stop surface included in the locking tab when the closure is in the installed position on the container, and wherein the movable release element is coupled to the container to cause the locking tab to pivot about the horizontal pivot axis during exposure to a second pivot-inducing force applied to the locking tab by the movable release element during movement of the movable release element into the product storage chamber in a downward direction away from the closure to move the stop surface included in the locking tab away from confronting relation with the first rotation-blocking stop to free the closure for rotation about the vertical axis of rotation in the second closure-removal direction relative to the container during removal of the closure from the container.

2. The child-resistant package of claim 1, wherein the closure-release control mechanism further includes a second rotation-blocking stop coupled to the closure to rotate therewith, wherein the second rotation-blocking stop is located in spaced-apart relation to the first rotation-blocking stop to locate the mouth of the container therebetween when the closure is coupled to the container in the installed position.

3. The child-resistant package of claim 2, wherein the closure includes a top surface arranged to close the mouth when the closure is in the installed position, a retainer ring coupled to the top surface to extend downwardly around the mouth when the closure is in the installed position, and a rim coupled to the top surface in spaced-apart radial relation to the retainer ring and arranged to extend away from the top surface toward the container when the closure is in the installed position.

4. The child-resistant package of claim 3, wherein the first rotation-blocking stop is located in a space formed in the closure and defined by the top surface, the retainer ring, and the rim.

5. The child-resistant package of claim 4, wherein the first rotation-blocking stop is appended to the top surface, the retainer ring, and the rim.

6. The child-resistant package of claim 5, wherein the first rotation-blocking stop includes a stop body arranged to extend between and interconnect the rim and the retainer ring and arranged to extend downwardly away from the top surface toward the container when the closure is in the installed position and a stop arm appended to the stop body and the rim and arranged to extend downwardly to engage the locking tab when the closure is in the installed position, the first rotation-blocking stop is located in spaced-apart relation above the locking tab when the closure is in the installed position.

7. The child-resistant package of claim 1, wherein the movable release element includes a deformable flange coupled to the container to extend away from the closure and a raised engagement ridge coupled to the deformable flange to extend away from the container toward the closure.

8. The child-resistant package of claim 7, wherein the locking tab is coupled to the deformable flange to move therewith and is located between the raised engagement ridge and a filler neck included in the container.

9. The child-resistant package of claim 8, wherein the deformable flange includes a coupled end coupled to the container, an opposite ridge end located in spaced-apart relation to the coupled end, and an upper surface arranged to extend between and interconnect the coupled end and the ridge end and to face upwardly toward the closure.

10. The child-resistant package of claim 9, wherein the raised engagement ridge is coupled to the upper surface to extend upwardly toward the closure and is located between the ridge end and the locking tab.

11. The child-resistant package of claim 8, wherein the container includes the filler neck, a side wall, and a platform coupled to the side wall and arranged to extend between and interconnect the side wall to the filler neck.

12. The child-resistant package of claim 1, wherein the movable release element includes a deformable flange coupled to the container to extend away from the closure and a raised engagement ridge coupled to the deformable flange to extend away from the container toward the closure, and the deformable flange includes a coupled end coupled to the container, an opposite ridge end located in spaced-apart relation to the coupled end, a first side extending between and interconnecting the coupled and ridge ends, an opposite second side extending between and interconnecting the coupled and ridge ends, and an upper surface arranged to extend between and interconnect the coupled end, the ridge end, and the first and second sides and to face upwardly toward the closure.

13. The child-resistant package of claim 12, wherein the locking tab is appended to the upper surface and is located between the first side and the second side of the deformable flange.

14. The child-resistant package of claim 13, wherein the locking tab extends from the first side of the deformable flange toward the second side of the deformable flange and is in spaced-apart relation to the second side.

15. The child-resistant package of claim 14, wherein the sloped upper surface of the locking tab terminates at the first side of the deformable flange and is arranged to extend away from the first side toward the closure and the second side.

16. The child-resistant package of claim 15, wherein the stop surface is arranged to extend between and interconnect the sloped upper surface of the locking tab and the upper surface of the deformable flange and is arranged to face toward the second side of the deformable flange.

17. The child-resistant package of claim 1, wherein the closure is mounted to the container to close the mouth, the closure-release control mechanism further includes a second rotation-blocking stop coupled to the closure to rotate therewith and located in spaced-apart relation to the first rotation-blocking stop to locate the mouth of the container therebetween, the closure includes a top surface closing the mouth, a retainer ring coupled to the top surface and arranged to extend downwardly around the mouth, and a rim coupled to the top surface in spaced-apart radial relation to the retainer ring and arranged to extend away from the top surface toward the container, and the first and second rotation-blocking stops are located in a space defined by the top surface, the retainer ring, and the rim.

18. The child-resistant package of claim 17, wherein the movable release element includes a deformable flange coupled to the container to extend away from the closure and a raised engagement ridge coupled to the deformable flange to extend away from the container toward the closure and the locking tab is coupled to the deformable flange to move therewith and is located between the raised engagement ridge and a filler neck included in the container.

19. The child-resistant package of claim 18, wherein the deformable flange includes a coupled end coupled to the container, an opposite ridge end located in spaced-apart relation to the coupled end, a first side extending between and interconnecting the coupled and ridge ends, an opposite second side extending between and interconnecting the coupled end, and an upper surface arranged to extend between and interconnect the coupled and ridge ends and the first and second sides and to face upwardly toward the closure, the locking tab is appended to the upper surface and arranged to extend from the first side toward the second side and lie in spaced-apart relation to the second side.

20. A child-resistant package comprising a container formed to include a product-storage chamber and a mouth opening into the product-storage chamber, a closure configured to mount on the container to assume an installed position closing the mouth when rotated relative to the container about a vertical axis of rotation in a first closure-installation direction, and a closure-release control mechanism comprising a rotation-blocking stop coupled to the closure to rotate therewith about the vertical axis of rotation during installation of the closure on the container and removal of the closure from the container, a movable release element coupled to the container for downward movement into the product storage chamber away from the closure, and a locking tab coupled to the movable release element for movement therewith and arranged to engage the rotation-blocking stop to block rotation of the closure about the vertical axis of rotation in a second closure-removal direction to retain the closure in the installed position on the container.

21. The child-resistant package of claim 20, wherein the locking tab includes a sloped upper surface and a stop surface and the movable release element is coupled to the container to cause the locking tab to pivot downwardly about a horizontal pivot axis in response to a first pivot-inducing force applied to the sloped upper surface included in the locking tab by the rotation-blocking stop during rotation of the closure about the vertical axis of rotation in the first closure-installation direction to free the rotation-blocking stop to confront the stop surface included in the locking tab when the closure is in the installed position on the container.

22. The child-resistant package of claim 21, wherein the movable release element is coupled to the container to cause the locking tab to pivot downwardly about the horizontal pivot axis during exposure to a second pivot-inducing force applied to the locking tab by the movable release element during movement of the movable release element relative to the container in a downward direction away from the closure to move the stop surface included in the locking tab away from confronting relation with the rotation-blocking stop to free the closure for rotation about the vertical axis of rotation in the second closure-removal direction relative to the container during removal of the closure from the container.

* * * * *